US007510680B2

(12) United States Patent
Steibel et al.

(10) Patent No.: US 7,510,680 B2
(45) Date of Patent: Mar. 31, 2009

(54) METHOD FOR PRODUCING A METALLIC ALLOY BY DISSOLUTION, OXIDATION AND CHEMICAL REDUCTION

(75) Inventors: James Dale Steibel, Mason, OH (US); Andrew Philip Woodfield, Madeira, OH (US)

(73) Assignee: General Electric Company, Schenectady, NY (US)

( * ) Notice: Subject to any disclaimer, the term of this patent is extended or adjusted under 35 U.S.C. 154(b) by 1019 days.

(21) Appl. No.: 10/318,763

(22) Filed: Dec. 13, 2002

(65) Prior Publication Data

US 2004/0115085 A1 Jun. 17, 2004

(51) Int. Cl.
*B22F 1/00* (2006.01)
*C22C 1/10* (2006.01)

(52) U.S. Cl. ..... 419/34; 419/63

(58) Field of Classification Search ..... 75/416, 75/351, 362, 612, 613; 419/30, 31, 34, 63
See application file for complete search history.

(56) References Cited

U.S. PATENT DOCUMENTS

| | | | | |
|---|---|---|---|---|
| 3,330,697 | A | 7/1967 | Pechini | |
| 3,923,496 | A * | 12/1975 | Pall | 75/365 |
| 3,925,114 | A * | 12/1975 | Takahashi et al. | 148/105 |
| 4,356,029 | A * | 10/1982 | Down et al. | 75/346 |
| 4,537,625 | A * | 8/1985 | Tenhover et al. | 419/36 |
| 4,687,632 | A * | 8/1987 | Hurd et al. | 419/45 |
| 5,322,666 | A | 6/1994 | Watwe | |
| 5,324,341 | A * | 6/1994 | Nagel et al. | 75/503 |
| 5,460,642 | A * | 10/1995 | Leland | 75/617 |
| 5,468,457 | A * | 11/1995 | Dorfman et al. | 423/61 |
| 5,470,549 | A * | 11/1995 | Dorfman et al. | 423/61 |
| 5,505,902 | A * | 4/1996 | Fischer et al. | 419/10 |
| 5,709,783 | A * | 1/1998 | Sanchez et al. | 156/89.12 |

(Continued)

FOREIGN PATENT DOCUMENTS

JP 59107904 6/1984

(Continued)

OTHER PUBLICATIONS

Webster's Seventh New Collegiate Dictionary, G. & C. Merriam Company, Publishers, 1965, p. 603, definition of "oxidize".*

(Continued)

*Primary Examiner*—Roy King
*Assistant Examiner*—Tima M McGuthry-Banks
(74) *Attorney, Agent, or Firm*—McNees Wallace & Nurick, LLC

(57) ABSTRACT

A metallic alloy having at least two metallic constituents is produced by first furnishing at least two non-oxide compounds, wherein the non-oxide compounds collectively comprise each of the metallic constituents, and wherein each of the non-oxide compounds is soluble in a mutual solvent. The method further includes dissolving the non-oxide compounds in the mutual solvent to produce a solution containing the metallic constituents, thereafter heating the solution to remove the mutual solvent and oxidize the metallic constituents to produce a mixed metallic oxide, thereafter cooling the mixed metallic oxide to form a substantially homogeneous mixed metallic oxide solid mass, and thereafter chemically reducing the mixed metallic oxide solid mass to produce a metallic alloy. The metallic alloy may be consolidated or otherwise processed.

27 Claims, 2 Drawing Sheets

U.S. PATENT DOCUMENTS

| | | | | |
|---|---|---|---|---|
| 5,759,230 | A * | 6/1998 | Chow et al. | 75/362 |
| 5,779,761 | A | 7/1998 | Armstrong et al. | |
| 5,849,652 | A * | 12/1998 | Davies et al. | 502/60 |
| 5,930,580 | A | 7/1999 | Everett | |
| 5,958,106 | A | 9/1999 | Armstrong et al. | |
| 6,179,899 | B1 * | 1/2001 | Higa et al. | 75/722 |
| 6,334,908 | B1 * | 1/2002 | Kawano et al. | 148/301 |
| 6,344,271 | B1 * | 2/2002 | Yadav et al. | 428/402 |
| 6,410,160 | B1 * | 6/2002 | Landin et al. | 428/613 |
| 6,464,750 | B1 * | 10/2002 | Tailhades et al. | 75/246 |
| 6,482,387 | B1 | 11/2002 | Gulgun et al. | |
| 6,530,972 | B2 * | 3/2003 | Akimoto et al. | 75/351 |
| 6,540,843 | B1 * | 4/2003 | Liu et al. | 148/243 |
| 6,699,305 | B2 * | 3/2004 | Myrick | 75/351 |
| 6,719,821 | B2 * | 4/2004 | Yadav et al. | 75/343 |
| 6,737,017 | B2 * | 5/2004 | Woodfield et al. | 419/30 |
| 6,887,296 | B2 * | 5/2005 | Mende et al. | 75/351 |
| 6,921,473 | B2 * | 7/2005 | Ward-Close et al. | 205/363 |
| 6,958,115 | B2 * | 10/2005 | O'Gardy et al. | 205/367 |
| 2002/0015889 | A1 * | 2/2002 | Yamamoto et al. | 429/231.95 |
| 2004/0055419 | A1 * | 3/2004 | Kurihara et al. | 75/362 |

FOREIGN PATENT DOCUMENTS

| | | | |
|---|---|---|---|
| WO | WO-94/01361 | | 1/1994 |
| WO | WO99/64638 | | 12/1999 |
| WO | WO 9964638 | | 12/1999 |
| WO | WO 01/46484 | A1 * | 6/2001 |

OTHER PUBLICATIONS

Julius Grant, ed., Hackh's Chemical Dictionary 480-481, 4th Ed., 1969.*

* cited by examiner

METHOD FOR PRODUCING A METALLIC ALLOY BY DISSOLUTION, OXIDATION AND CHEMICAL REDUCTION

This invention relates to the production of metallic alloys and metallic-alloy articles and, more particularly, to their production from solutions of the metallic constituents.

BACKGROUND OF THE INVENTION

Metallic articles are fabricated by any of a number of techniques, as may be appropriate for the nature of the metal and the article. In one common approach, metal-containing ores are refined to produce a molten metal, which is thereafter cast. The metal is refined as necessary to remove or reduce the amounts of undesirable minor elements. The composition of the refined metal is usually modified by the addition of desirable alloying constituents. These refining and alloying steps may be performed during the initial melting process or after solidification and remelting. After a metal of the desired composition is produced, it may be used in the as-cast form for some alloy compositions (i.e., cast alloys), or further worked to form the metal to the desired shape for other alloy compositions (i.e., wrought alloys), or processed through another physical form (i.e., powder which is thereafter consolidated). In these approaches, further processing such as heat treating, machining, surface coating, and the like may be employed.

Some metallic alloys are relatively straightforward to produce by this general approach. The alloying elements are thermophysically compatible in the molten state, so that the alloys may be produced by melting and processing. However, in the subsequent processing operations complications may develop. The cast or cast-and-worked alloys may exhibit irregularities in macrostructure and microstructure that interfere with the realization of the potential properties of the alloys. For example, there may be extensive defect structures, there may be chemical inhomogeneities, there may be a tendency to cracking that reduces the fatigue life of the final product, it may not be possible to inspect the product sufficiently, and/or the grain size may be too large to impart the desired properties. The costs of production may be high and prohibitive for some applications.

The production of other metallic alloys is complicated in many cases by the differences in the thermophysical properties of the elemental metallic constituents being combined to produce the alloy. The interactions and reactions due to these thermophysical properties of the metallic constituents may cause undesirable results. In one commercially important example, in most cases titanium alloys must be melted in a vacuum because of their reactivity with oxygen and nitrogen in the air. In the work leading to the present invention, the inventors have realized that the necessity to melt under a vacuum makes it difficult to utilize some desirable alloying elements due to the differences in their relative vapor pressures in a vacuum environment. The difference in the vapor pressures is one of the thermophysical properties that must be considered in alloying titanium. In other cases, the metallic alloying constituents may be thermophysically incompatible with the molten titanium because of other thermophysical characteristics such as melting points, densities, chemical reactivities and tendency of strong beta stabilizers to segregate. Some of the incompatibilities may be overcome with the use of expensive master alloys, but this approach is not applicable in other cases. And even where the thermophysical incompatibilities are overcome, there may be difficulty in achieving homogeneity in the alloys due to the manner of melting.

Thus, there is a need for an improved approach to producing alloys of titanium and other metals, with added metallic alloying constituents. The need extends both to conventional meltable alloys, where microstructural and microstructural limitations must be overcome, and non-meltable alloys, in which the previous alloying limitations are overcome and the alloys may be made highly homogeneous. The present invention fulfills this need, and further provides related advantages.

BRIEF SUMMARY OF THE INVENTION

The present approach provides a technique for producing a metallic-alloy material having at least two metallic constituents. The approach circumvents the commonly encountered macrostructural, microstructural, thermophysical, and other types of incompatibilities that make the manufacture of many types of alloys in their most-desirable forms difficult or impossible. The resulting metallic alloys are substantially fully homogeneous, but may be subsequently processed using conventional thermomechanical and other techniques.

A method for producing a metallic alloy having at least two metallic constituents first requires furnishing at least two non-oxide compounds, wherein the non-oxide compounds collectively comprise each of the metallic constituents, and wherein each of the non-oxide compounds is soluble in a mutual solvent. The method includes thereafter dissolving the non-oxide compounds in the mutual solvent to produce a solution containing the metallic constituents, thereafter heating the solution to remove the mutual solvent and oxidize the metallic constituents to produce a mixed metallic oxide, thereafter cooling the mixed metallic oxide to form a substantially homogeneous mixed metallic oxide solid mass, and thereafter chemically reducing the mixed metallic oxide solid mass to produce a metallic alloy.

A base metal constituent of the non-oxide compounds, present in an amount (by weight) greater than any other metallic constituent, is preferably titanium, nickel, iron, or cobalt. More preferably, the base metal constituent is titanium, so that the metallic alloy is a titanium alloy. Titanium alloys are of particular interest because in many cases they are difficult to produce in an acceptable physical state by conventional melting and casting. Preferably but not necessarily, the base-metal is present in an amount of at least 50 percent by weight of a total weight of the metallic constituents. As used herein, the term "metallic alloy" includes both conventional metallic alloys and intermetallic compounds formed of metallic constituents.

The non-oxide compounds are of any operable type. They are preferably inorganic salts of the metals or organometallic compounds. The solvent may be an inorganic solvent or an organic solvent, or a mixture of such solvents, that together form a solution of the non-oxide compounds. As used herein, "solution" and the like includes both true solutions in which the solute is dissolved in the solvent, and also forms such as colloidal solutions (i.e., dispersions) wherein the dispersed phase is very finely divided (typically less than about 1 micrometer in size) and dispersed within the liquid phase. Both the true solution and the colloidal solution achieve the benefits of the present approach, by closely associating the non-oxide compounds on an atomic or near-atomic level. "Dissolving" and the like refer to the process of forming either true solutions or colloidal solutions.

The step of chemically reducing is preferably performed by solid-phase reduction. An operable technique is fused salt electrolysis. The chemical reduction preferably produces the metallic alloy as a finely divided particulate form or as a sponge.

After the chemical reduction, the metallic alloy may be consolidated to produce a consolidated metallic article. The consolidation, when used, is preferably performed without melting the metallic alloy and without melting the consolidated metallic article. However, the chemical reduction may be followed by melting and solidifying the metallic alloy, but preferably without mechanical comminution of the metallic alloy.

In a preferred approach, a method for producing a metallic alloy having at least two metallic constituents comprises the step of furnishing at least two non-oxide compounds selected from the group consisting of metallic salts and organometallic compounds, and mixtures thereof. The non-oxide compounds collectively comprise each of the metallic constituents, a base metal constituent, present in an amount greater than any other metallic constituent, is titanium, and each of the non-oxide compounds is soluble in a mutual solvent. The method further includes thereafter dissolving the non-oxide compounds in the mutual solvent to produce a solution containing the metallic constituents, thereafter heating the solution to remove the mutual solvent and oxidize the metallic constituents to produce a mixed metallic oxide, thereafter cooling the mixed metallic oxide to form a substantially homogeneous mixed metallic oxide solid mass in a fine particulate form, and thereafter chemically reducing the mixed metallic oxide solid mass to produce a metallic alloy. It is preferred to perform an additional step, after the step of chemically reducing, of consolidating the metallic alloy to produce a consolidated metallic-alloy article.

In its preferred embodiment, the present approach produces substantially fully homogeneous metallic oxide alloy powders. These metallic oxide powders are used in a chemical reduction from the oxide form to the metallic form. There are many other ways to produce masses of metallic alloy powders, such as melting followed by spray atomization of alloys, blending of powders of other alloys, mechanical alloying of non-alloyed or other composition of alloy powders, and the like. These other techniques suffer from the drawbacks that they require melting that does not allow alloying of thermophysically incompatible elements, require vacuum melting, or introduce extensive defect structures that cannot be readily removed by subsequent processing. The present approach, on the other hand, does not require melting of the metals, at least prior to the chemical reduction (although the metallic alloy may subsequently be melted). There is therefore no requirement for vacuum melting. The resulting metallic alloy may be made to be free of mechanical defects such as those introduced in mechanical alloying procedures.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
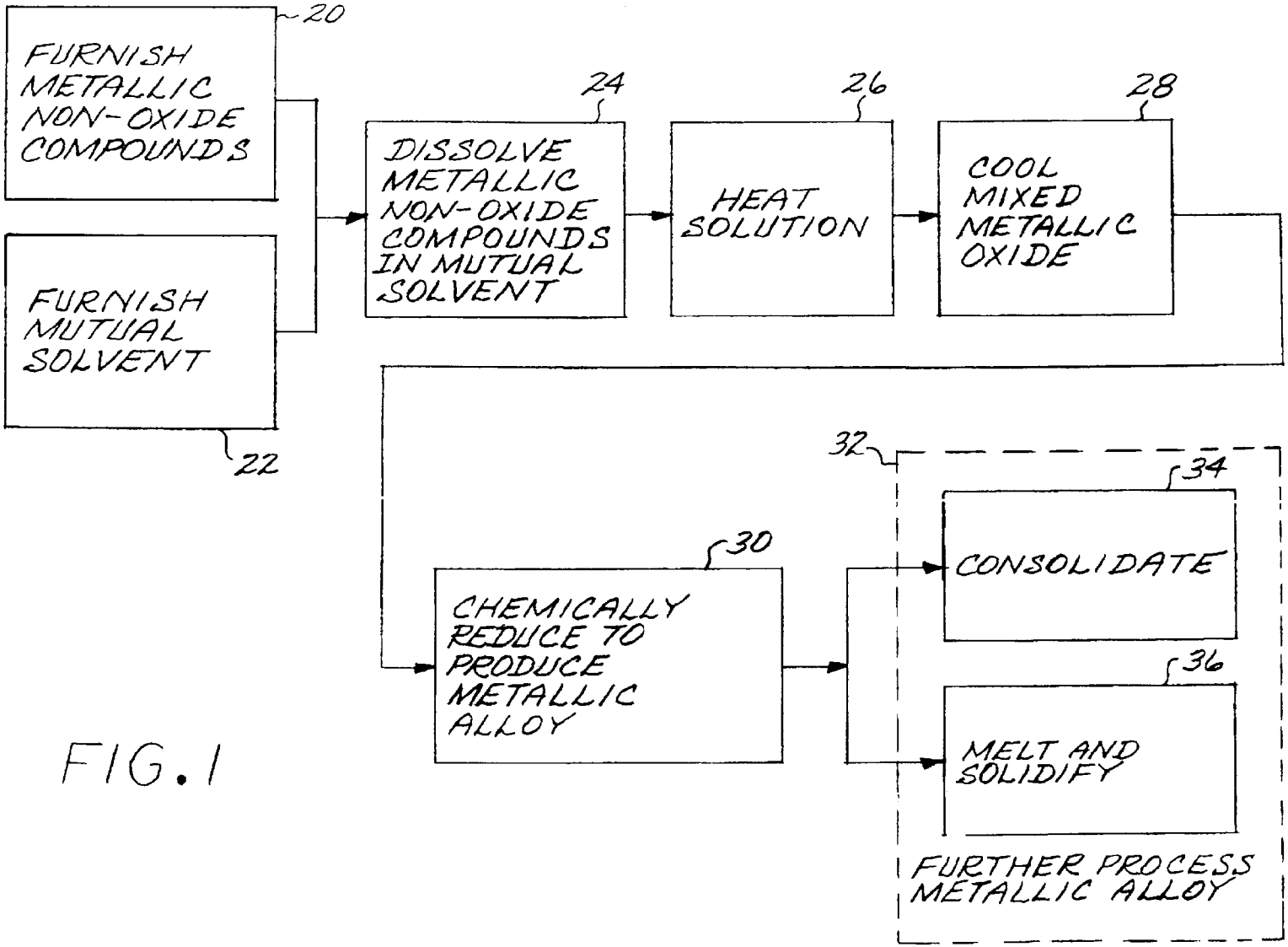
FIG. 1 is a block flow diagram of a preferred approach for practicing the invention.

The present approach, as illustrated in FIG. 1, is embodied in a method for producing a metallic material having at least two metallic constituents, commonly termed a "metallic alloy". As used herein, the term "metallic alloy" includes both conventional metallic alloys and intermetallic compounds formed of metallic constituents, such as approximately equiatomic TiAl. Relatively small amounts of nonmetallic elements, such as boron, carbon, and silicon, may also be present. The approach includes furnishing at least two non-oxide compounds, step 20. The non-oxide compounds collectively comprise each of the metallic constituents. The non-oxide compounds may not be the simple oxides of the metallic elements, although the non-oxide compounds may contain some oxygen. That is, the non-oxide compounds collectively contain all of the metallic elements of the final metallic alloy, in the required proportions of the final metallic alloy. The metallic elements may be supplied by the non-oxide compounds in various ways. In the preferred approach, there is exactly one non-oxide compound for each alloying element, and that one compound provides all of the material for that respective metallic constituent in the alloy. That is, for a three-element metallic alloy that is the final result of the process, a first non-oxide compound supplies all of the first element, a second non-oxide compound supplies all of the second element, and a third non-oxide compound supplies all of the third element. Alternatives are within the scope of the approach, however. For example, several of the non-oxide compounds may together supply all of one particular metallic element. In another alternative, one non-oxide compound may supply all or part of two or more of the metallic elements. The latter approaches are less preferred, because they make more difficult the precise determination of the elemental proportions in the final metallic alloy. The final metallic alloy is typically not a stoichiometric compound, wherein the proportions of the elements reacting to form the compound are always the same.

A mutual solvent for the non-oxide compounds is furnished, step 22. The "mutual solvent" is a single solvent compound or mixture of solvent compounds that dissolves all of the non-oxide compounds (or forms a colloidal solution of the non-oxide compounds). The mutual solvent may be an inorganic compound, an organic compound, or a mixture of compounds, and other constituents such as chelating agents or carrier polymers may optionally be present in the mutual solvent. The use of the mutual solvent places additional limitations on the selection of the non-oxide compounds, as they must all be dissolvable by, or formed into a colloidal solution by, the same mutual solvent.

The selection of the specific non-oxide compounds and the specific mutual solvent is dependent upon the specific metallic constituents and proportions of the final metallic alloy. In the preferred approach, the base metal constituent of the final metallic alloy, present in an amount by weight greater than any other metallic constituent, is titanium, nickel, iron, or cobalt, but most preferably titanium, but other base metals are operable as well. In the presently preferred embodiment, titanium is present in an amount by weight greater than any other metallic constituent. In a common situation, the base metal is present in an amount of at least 50 percent by weight of a total weight of the metallic constituents.

To make a titanium-base metallic alloy by the present approach, the preferred non-oxide compounds are inorganic salts of the metals, such as carbonates and/or nitrates, or organometallic compounds, such as isopropoxides. Some of the metallic elements may be supplied by one class of non-oxide compound (e.g., nitrates of the respective metallic elements), and others of the metallic elements may be supplied by another class of non-oxide compounds (e.g., isopropoxides of the respective metallic elements). To cite a specific example, a preferred metallic alloy of particular interest is Ti-6Al-4V, which contains about 6 weight percent aluminum, about 4 weight percent vanadium, balance titanium and minor elements. To make a Ti-6Al-4V metallic alloy, the titanium is supplied by titanium isopropoxide, the aluminum is supplied by aluminum nitrate or aluminum isopropoxide, and the vanadium is supplied by vanadium triisopropoxide, all furnishing the proper proportions of titanium, aluminum, and vanadium. Any operable mutual solvent for all of these non-oxide compounds may be used, but the preferred mutual solvent is an inorganic solvent such as water, an organic solvent such as isopropyl alcohol, or a mixture of such solvents. Some examples of other operable compounds and solvents for individual non-oxide compounds are found in U.S. Pat. Nos. 3,330,697 and 6,482,387, whose disclosures are incorporated by reference.

Non-oxide compounds of non-metallic constituents may also be supplied and used. For example, elements such as rare earths, boron, silicon, and the like are not considered metals. However, they are often present in metallic alloys to provide specific properties to the final metallic alloy. Non-oxide compounds of such elements may be provided and mixed with the non-oxide compounds of the metallic constituents, which form the great majority of the final metallic alloy.

The non-oxide compounds are thereafter dissolved in the mutual solvent to produce a solution containing the metallic constituents, step 24, with mixing of the various non-oxide compounds in the solution. This dissolution step 24 is particularly important, because it ensures that all of the metallic constituents will be completely and intimately intermixed in the final metallic alloy. This in-solution intermixing overcomes the problem found in many other alloying approaches that complete mixing of the metallic constituents is not achieved, or only achieved in the presence of mechanical defects or the like.

The solution is thereafter heated to remove the mutual solvent and oxidize (i.e., calcine) the metallic constituents to produce a mixed metallic oxide, step 26. The heating is performed in an oxygen-containing atmosphere, typically air, pure oxygen, or a controlled mixture of oxygen and another element. The heating 26 typically causes the mutual solvent to evaporate first as the solution is heated through low and intermediate temperatures, depositing as a residue the completely mixed non-oxide compounds. The heating and solvent evaporation may be accomplished by any operable technique, for example, by a spray process in which the solution is sprayed into a hot chamber. At higher temperatures, the mixed non-oxide compounds react with the oxygen to form a complex mixed oxide having all of the metallic constituents therein.

The mixed metallic oxide is thereafter cooled, step 28, to form a substantially homogeneous mixed metallic oxide solid mass. Because the mixed metallic oxide solid mass originates in the solution produced in step 24, the metallic constituents in the form of the mixed oxide are fully mixed together on an atomic level.

The mixed metallic oxide is thereafter chemically reduced to produce a metallic alloy, step 30. (As used herein, chemical reduction is the inverse of chemical oxidation.) Because the metallic constituents are fully mixed together and are substantially fully homogeneous in the mixed oxide state, they are fully mixed together and are substantially fully homogeneous in the metallic alloy. This high degree of homogeneity is important, because it is as good as, or in some instances better than, the state produced by melting and casting. There are homogeneity limitations in the casting and melting of metallic alloys, however, due to elemental segregation during solidification and because some elements are immiscible or otherwise difficult or impossible to incorporate in a homogeneous metallic alloy.

The chemical reduction may be by any operable approach. The chemical reduction is preferably a solid-phase approach, wherein the metallic constituents are never melted. In a most-preferred solid phase chemical reduction approach, the chemical reduction may be performed by fused salt electrolysis. Fused salt electrolysis is a known technique that is described, for example, in published patent application WO 99/64638, whose disclosure is incorporated by reference in its entirety. Briefly, in fused salt electrolysis the mixed metallic oxide, preferably furnished in a finely divided solid form, is immersed in an electrolysis cell in a fused salt electrolyte such as a chloride salt at a temperature below the melting temperatures of the metals that form the nonmetallic precursor compounds. The mixed metallic oxide is made the cathode of the electrolysis cell, with an inert anode. The oxygen combined with the metallic elements is partially or completely removed from the mixture by chemical reduction. The reaction is performed at an elevated temperature to accelerate the diffusion of the oxygen or other gas away from the cathode. The cathodic potential is controlled to ensure that the reduction of the mixed metallic oxide will occur, rather than other possible chemical reactions such as the decomposition of the molten salt. The electrolyte is a salt, preferably a salt that is more stable than the equivalent salt of the metals being refined and ideally very stable to remove the oxygen or other gas to a desired low level. The chlorides and mixtures of chlorides of barium, calcium, cesium, lithium, strontium, and yttrium are preferred are the electrolyte. The chemical reduction is preferably, but not necessarily, carried to completion, so that the mixed metallic oxide is completely reduced. Not carrying the process to completion is a method to control the oxygen content of the metallic alloy produced.

After the chemical reduction of step 30, the metallic alloy is typically further processed, step 32. The further processing, if performed, may be of any operable type. Most preferably, the metallic alloy is consolidated to produce a consolidated metallic article, step 34. The finely divided metallic alloy is consolidated into a metallic article by any operable approach. Examples include hot or cold pressing, hot isostatic pressing, canned extrusion, a combination of canned extrusion and forging, and the like. Such procedures are known in the art for processing starting material in finely divided particulate form, and they may be used in relation to the metallic alloy. The preferred consolidation is accomplished without melting the metallic alloy and without melting the consolidated metallic article. Such melting might introduce defects and microstructural inhomogeneities that are otherwise absent due to the approach for reaching the metallic alloy of step 30.

Figure 2:
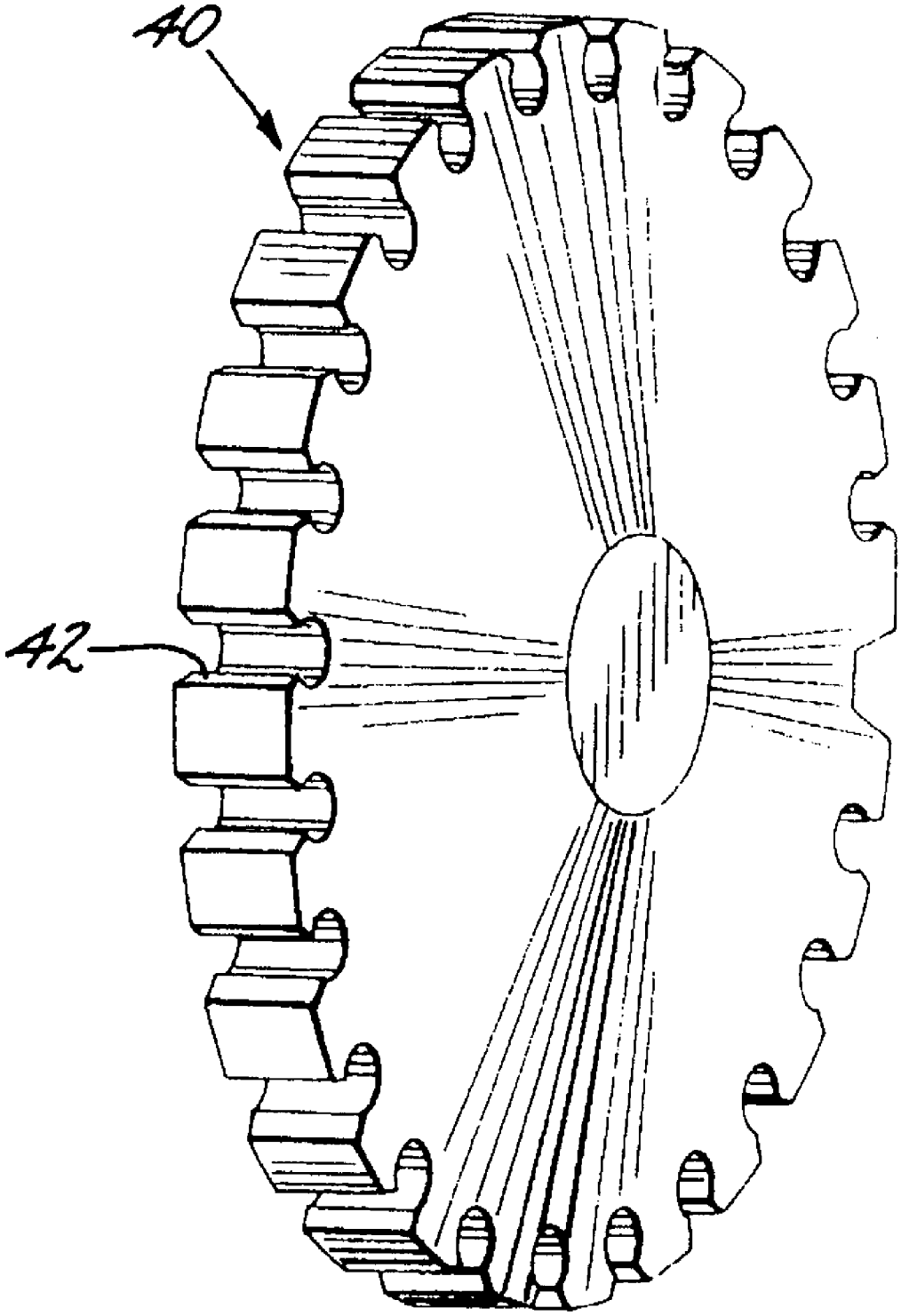
FIG. 2 is a perspective view of a metallic article prepared by the present approach.

FIG. 2 depicts an example of a consolidated metallic article 40, in this case a component of a gas turbine engine. The illustrated consolidated metallic article 40 is a compressor disk or a fan disk, with slots 42 in the rim that are subsequently machined after the consolidation. A respective compressor blade or fan blade is received into each slot 42.

Alternatively, the metallic alloy may be melted and solidified, step 36, preferably without mechanical comminution of the metallic alloy. The melting and solidification approach is not preferred, because it may lead to the very type of alloy inhomogeneity that the steps 20-30 take care to avoid. However, in some specific applications melting and solidification may be used.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for producing a metallic alloy having at least two metallic constituents, comprising the steps of furnishing at least two non-oxide compounds, wherein the non-oxide compounds collectively comprise each of the metallic constituents, wherein each of the non-oxide compounds is soluble in a mutual solvent, and wherein a base metal constituent, present in an amount by weight greater than any other metallic constituent, is selected from the group consisting of titanium, nickel, iron, and cobalt; thereafter dissolving the non-oxide compounds in the mutual solvent to produce a solution containing the metallic constituents; thereafter heating the solution to remove the mutual solvent and oxidize the metallic constituents to produce a mixed metallic oxide; thereafter cooling the mixed metallic oxide to form a substantially homogeneous mixed metallic oxide solid mass; and thereafter chemically reducing the mixed metallic oxide solid mass to produce a metallic alloy.

2. The method of claim 1, wherein the step of furnishing the at least two non-oxide compounds includes the step of furnishing the base metal constituent in an amount of at least 50 percent by weight of a total weight of the metallic constituents.

3. The method of claim 1, wherein the step of furnishing the at least two non-oxide compounds includes the step of furnishing the base metal constituent as titanium.

4. The method of claim 1, wherein the step of furnishing the at least two non-oxide compounds includes the step of furnishing the non-oxide compounds selected from the group consisting of an inorganic salt and an organometallic compound.

5. The method of claim 1, wherein the step of dissolving includes the step of furnishing an organic solvent.

6. The method of claim 1, wherein the step of dissolving includes the step of furnishing an inorganic solvent.

7. The method of claim 1, wherein the step of chemically reducing includes the step of producing the metallic alloy as a finely divided particulate form.

8. The method of claim 1, wherein the step of chemically reducing includes the step of chemically reducing mixed metallic oxide solid mass by solid-phase reduction.

9. The method of claim 1, wherein the step of chemically reducing includes the step of chemically reducing the mixed metallic oxide solid mass by fused salt electrolysis.

10. The method of claim 1, including an additional step, after the step of chemically reducing, of consolidating the metallic alloy to produce a consolidated metallic article.

11. The method of claim 1, wherein the method includes an additional step, after the step of chemically reducing, of consolidating the metallic alloy to produce a consolidated metallic article, without melting the metallic alloy and without melting the consolidated metallic article.

12. The method of claim 1, including an additional step, after the step of chemically reducing, of melting and solidifying the metallic alloy, wherein there is no mechanical comminution of the metallic alloy.

13. A method for producing a metallic alloy having at least two metallic constituents, comprising the steps of furnishing at least two non-oxide compounds, wherein the non-oxide compounds collectively comprise each of the metallic constituents, wherein a base metal constituent, present in an amount by weight greater than any other metallic constituent, is titanium, and wherein each of the non-oxide compounds is soluble in a mutual solvent; thereafter dissolving the non-oxide compounds in the mutual solvent to produce a solution containing the metallic constituents; thereafter heating the solution to remove the mutual solvent and oxidize the metallic constituents to produce a mixed metallic oxide; thereafter cooling the mixed metallic oxide to form a substantially homogeneous mixed metallic oxide solid mass in a fine particulate form; and thereafter chemically reducing the mixed metallic oxide solid mass to produce a metallic alloy.

14. The method of claim 13, wherein the step of furnishing the at least two non-oxide compounds includes the step of furnishing the non-oxide compounds selected from the group consisting of an inorganic salt and an organometallic compound.

15. The method of claim 13, including an additional step, after the step of chemically reducing, of consolidating the metallic alloy to produce a consolidated metallic article.

16. A method for producing a metallic alloy having at least two metallic constituents, comprising the steps of furnishing at least two non-oxide compounds, wherein the non-oxide compounds collectively comprise each of the metallic constituents, and wherein each of the non-oxide compounds is soluble in a mutual organic solvent; thereafter dissolving the non-oxide compounds in the mutual organic solvent to produce a solution containing the metallic constituents; thereafter heating the solution to remove the mutual organic solvent and oxidize the metallic constituents to produce a mixed metallic oxide; thereafter cooling the mixed metallic oxide to form a substantially homogeneous mixed metallic oxide solid mass; and thereafter chemically reducing the mixed metallic oxide solid mass to produce a metallic alloy.

17. The method of claim 16, wherein the step of furnishing the at least two non-oxide compounds includes the step of furnishing the non-oxide compounds wherein a base metal constituent, present in an amount by weight greater than any other metallic constituent, is selected from the group consisting of titanium, nickel, iron, and cobalt.

18. A method for producing a metallic alloy having at least two metallic constituents, comprising the steps of furnishing at least two non-oxide compounds, wherein the non-oxide compounds collectively comprise each of the metallic constituents, and wherein each of the non-oxide compounds is soluble in a mutual solvent; thereafter dissolving the non-oxide compounds in the mutual solvent to produce a solution containing the metallic constituents; thereafter heating the solution to remove the mutual solvent and oxidize the metallic constituents to produce a mixed metallic oxide; thereafter cooling the mixed metallic oxide to form a substantially homogeneous mixed metallic oxide solid mass; and thereafter chemically reducing the mixed metallic oxide solid mass to produce a metallic alloy in a finely divided particulate form.

19. The method of claim 18, wherein the step of furnishing the at least two non-oxide compounds includes the step of furnishing the non-oxide compounds wherein a base metal constituent, present in an amount by weight greater than any other metallic constituent, is selected from the group consisting of titanium, nickel, iron, and cobalt.

20. A method for producing a metallic alloy having at least two metallic constituents, comprising the steps of furnishing at least two non-oxide compounds, wherein the non-oxide compounds collectively comprise each of the metallic constituents, and wherein each of the non-oxide compounds is soluble in a mutual solvent; thereafter dissolving the non-oxide compounds in the mutual solvent to produce a solution containing the metallic constituents; thereafter heating the solution to remove the mutual solvent and oxidize the metallic constituents to produce a mixed metallic oxide; thereafter cooling the mixed metallic oxide to form a substantially homogeneous mixed metallic oxide solid mass; and thereafter chemically reducing the mixed metallic oxide solid mass by fused salt electrolysis to produce a metallic alloy.

21. The method of claim 20, wherein the step of furnishing the at least two non-oxide compounds includes the step of furnishing the non-oxide compounds wherein a base metal constituent, present in an amount by weight greater than any other metallic constituent, is selected from the group consisting of titanium, nickel, iron, and cobalt.

22. A method for producing a metallic alloy having at least two metallic constituents, comprising the steps of furnishing at least two non-oxide compounds, wherein the non-oxide compounds collectively comprise each of the metallic constituents, and wherein each of the non-oxide compounds is soluble in a mutual solvent; thereafter dissolving the non-oxide compounds in the mutual solvent to produce a solution containing the metallic constituents; thereafter heating the solution to remove the mutual solvent and oxidize the metallic constituents to produce a mixed metallic oxide; thereafter cooling the mixed metallic oxide to form a substantially homogeneous mixed metallic oxide solid mass; thereafter chemically reducing the mixed metallic oxide solid mass to produce a metallic alloy; and thereafter consolidating the metallic alloy to produce a consolidated metallic article.

23. The method of claim 22, wherein the step of furnishing the at least two non-oxide compounds includes the step of furnishing the non-oxide compounds wherein a base metal constituent, present in an amount by weight greater than any other metallic constituent, is selected from the group consisting of titanium, nickel, iron, and cobalt.

24. The method of claim 22, wherein the step of consolidating includes the step of consolidating the metallic alloy to produce the consolidated metallic article, without melting the metallic alloy and without melting the consolidated metallic article.

25. A method for producing a metallic alloy having at least two metallic constituents, comprising the steps of furnishing at least two non-oxide compounds, wherein the non-oxide compounds collectively comprise each of the metallic constituents, and wherein each of the non-oxide compounds is soluble in a mutual solvent; thereafter dissolving the non-oxide compounds in the mutual solvent to produce a solution containing the metallic constituents; thereafter heating the solution to remove the mutual solvent and oxidize the metallic constituents to produce a mixed metallic oxide; thereafter cooling the mixed metallic oxide to form a substantially homogeneous mixed metallic oxide solid mass; thereafter chemically reducing the mixed metallic oxide solid mass to produce a metallic alloy; and thereafter melting and solidifying the metallic alloy, wherein there is no mechanical comminution of the metallic alloy.

26. The method of claim 25, wherein the step of furnishing the at least two non-oxide compounds includes the step of furnishing the non-oxide compounds wherein a base metal constituent, present in an amount by weight greater than any other metallic constituent, is selected from the group consisting of titanium, nickel, iron, and cobalt.

27. The method of claim 1, wherein the step of heating includes the steps of first evaporating the mutual solvent to produce a residue of mixed non-oxide compounds, and thereafter oxidizing the residue of the mixed non-oxide compounds by reaction with oxygen in an oxygen-containing atmosphere to form a complex mixed oxide having all of the metallic constituents therein.

* * * * *